US005866522A

United States Patent [19]

Eidenschink et al.

[11] Patent Number: 5,866,522

[45] Date of Patent: Feb. 2, 1999

[54] SULFUR CONTAINING AROMATIC LUBRICANT AND METHOD OF USING SAME

[75] Inventors: Rudolf Eidenschink, Mainz; Holger Kretzschmann, Bingen, both of Germany

[73] Assignee: Nematel Dr. Rudolf Eidenschink, Mainz, Germany

[21] Appl. No.: 818,602

[22] Filed: Mar. 14, 1997

[30] Foreign Application Priority Data

Mar. 25, 1996 [DE] Germany ..... 196 11 466.7

[51] Int. Cl.[6] ..... C10M 135/08; C10M 135/28

[52] U.S. Cl. ..... 508/568; 508/502; 508/570

[58] Field of Search ..... 508/568, 570, 508/502

[56] References Cited

U.S. PATENT DOCUMENTS

| | | | |
|---|---|---|---|
| 4,507,420 | 3/1985 | Rosenberger | 508/570 |
| 4,533,753 | 8/1985 | McKinnie et al. | 508/570 |
| 4,578,210 | 3/1986 | Praefcke et al. | 252/299.6 |
| 4,734,522 | 3/1988 | Praefcke et al. | 560/186 |
| 5,641,737 | 6/1997 | Forster | 508/568 |

OTHER PUBLICATIONS

D. Spath et al., Annals of the CIRP Gen. Assembly. vol 44/1, Enschede, 1995.

*Primary Examiner*—Ellen M. McAvoy
*Attorney, Agent, or Firm*—Michael L. Dunn

[57] ABSTRACT

A lubricant including a compound of the formula:

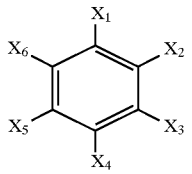

wherein 4, 5 or 6 of the substituents $X_1$ to $X_6$ can be —SR, —$SO_2$R or —SOR and the other substituents can be —H, —Cl, —F, —OH, —SH, —R, —OR, —COOR or —OOCR wherein R is independently, at each occurrence, unsubstituted or substituted alkyl, of 1 to 18 carbon atoms, said substitution consisting of fluorine substitution of hydrogen, —O— substitution of —$CH_2$—, —S— substitution of —$CH_2$— and mixtures thereof, said —O— and —S— substitutions being selected so that —O— atoms are not directly bonded to each other. The invention further includes a method of lubricating with the lubricant.

19 Claims, No Drawings

SULFUR CONTAINING AROMATIC LUBRICANT AND METHOD OF USING SAME

To reduce wear and power losses due to friction it is known for machine bearings and transmissions to be provided with a lubricant which during operation permits the solid bodies which are moved relative to each other to be separated as completely as possible. Lubricants can be subdivided into lubricating oils and lubricating greases. Mineral oils obtained from crude oil and synthetic oils such as polyalkylene glycols, ester oils, phosphoric acid esters and silicone are in use as lubricating oils (see an overview in Ullmanns Enzykl. der technischen Chemie, 4th edition, volume 20). Modern lubricating oils contain a series of additives which influence both the physical and also the chemical properties thereof. These are in particular oxidation inhibitors, detergents, high-pressure additives, friction-reducing agents, foam-preventing agents and corrosion inhibitors.

The wear phenomena and power losses which occur in a frictional pairing depend in a complex manner on the material of the machine component itself, the properties of the lubricating oil such as its viscosity and its interactions with the material, and the conditions in respect of pressure and speed. Closed support films are advantageous, as occur for example in the hydrodynamic range of plain bearings or in the elastohydrodynamic range of rolling bearings. High frictional losses—and the wear phenomena which are generally correlated therewith—occur in particular in plain bearings In the hybrid friction area (see VDI Berichte 680. Das Öl als Konstruktionselement. VDI-Verlag, Dusseldorf 1988).

Lubrication with lubricating greases is wide-spread. They comprise a lubricating oil and a solid body which is dispersed therein in fine form, the so-called thickener, which has only a slight influence on the tribological properties and which has primarily the function of a storage means for the lubricating oil.

The known lubricants are in need of improvement because many frictional pairings can be operated with them only with high frictional losses.

DE 33 32 955 specifies compounds of formula I as components for liquid-crystalline phases for electrooptical displays. DE 28 19 822 describes additives of less than 1% of tris- and tetracis[alkylthio]benzenes as anti-oxidants for conventional lubricants.

The object of the invention was to provide a new stable lubricant, by the use of which frictional pairings in transmissions and bearings can be operated with particularly low levels of frictional losses.

That object is attained by the use of one or more compounds of the general formula I

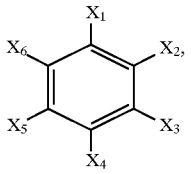

I wherein 4, 5 or 6 of the substituents $X_1$ to $X_6$ can be

—SR, —$SO_2$R or —SOR and the other substituents can be

—H, —Cl. —F, —OH, —SH, —R. —OR, —COOR or —OOCR wherein R independently of each other respectively denotes an alkyl residue which is unsubstituted or which is multiply substituted by fluorine with 1 to 18 C-atoms, wherein in that residue one or more $CH_2$-groups can be so replaced by —O— or —S— that O-atoms are not directly bonded to each other, as a lubricant.

It was surprisingly found that the sulphur-bearing lubricant according to the invention permits markedly lower levels of frictional losses in comparison with conventional lubricants in transmissions and bearings.

Besides one or more compounds of the formula I the lubricant according to the invention may also contain other compounds. They may be inter alia anti-oxidants, such as derivatives of 2.6-di-tert-butyl-phenol, high-pressure additives such as zinc-dialkyl-dithiophosphates, friction-reducing agents, light-protection agents, emulsifiers or de-emulsifiers. There may however also be organic compounds for varying the viscosity such as compounds whose molecules contain benzene or naphthalene nuclei which are multiply substituted by alkyl groups. If the lubricant according to the invention is a lubricating oil, those additives are present in molecular-disperse form in the homogenous liquid. The content of the additives which are dissolved in molecular-disperse form in the compounds of formula I, in the lubricating oil according to the invention, is at most 30%.

That lubricating oil can be converted into a lubricating grease which is also embraced by the present invention in generally known manner (see Ullmanns Enzykl.) by the addition of thickeners which are present in non-molecular-disperse form. Particularly suitable thickeners are lithium-12-hydroxystearate and powder of polytetrafluoroethylene (for example microteflon powder 5$\mu$, Dr. Tillwich GmbH, Horb). Within the present invention polymers which serve to form gels such as for example so-called side chain polymers (H. Ringsdorf et al, Angew. Chem. 101, 934 (1989) and literature quoted therein) and also inorganic solid additives such as molybdenum disulphide or graphide are considered among the thickeners. A lubricating grease according to the invention may contain up to 35% of such thickeners. The distinction between molecular-disperse and non-molecular-disperse substances can be made by an ultra centrifuging operation (for example with the Beckman L8-M ultra centrifuge with a centrifugal acceleration of between $7\times10^3$ and $6\times10^5$ m/$s^2$ at 25° C. 10 minutes), in per se known manner.

The compounds of formula I include the preferred subformulae Ia to Id (Y denotes independently of each other —SR, —$SO_2$R or —SOR, and Z denotes independently of each other —H, —Cl, —F, —R, —OH, —SH, —OR, —COOR or —OOCR):

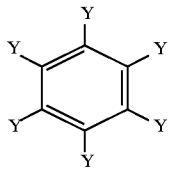

Ia

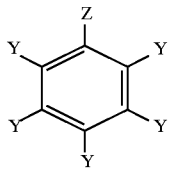

Ib

-continued

Ic

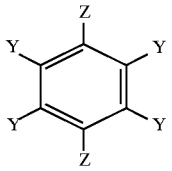

Id

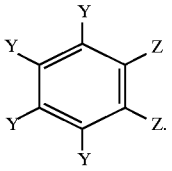

Among these sub-formulae Ia and Ib are particularly preferred.

Of the sulphur-bearing substituents Y, —SR and —$SO_2R$ are preferred while —SR is particularly preferred. The alkyl residues —R in the substituents Y in one and the same compound may be the same or different. This may involve branched or unbranched residues. Unbranched alkyl residues are preferred. Of these residues having 6 to 18 C-atoms are preferred, in particular hexyl, heptyl, octyl, nonyl, decyl, undecyl, dodecyl, tetradecyl, hexadecyl and octadecyl. Of the substituents Z in the sub-formulae Ia to Id, —H, —OR and —COOR are preferred, with —H being particularly preferred. The alkyl residues —R in the substituents Z are respectively independently of each other and preferably unbranched. They denote in particular methyl, ethyl, propyl, butyl, hexyl, heptyl, octyl, nonyl, decyl, undecyl, dodecyl, tetradecyl, hexadecyl and octadecyl.

Of the compounds of the sub-formula Ia in particular the following compounds are suitable:

Hexacis[hexylthio]benzene

Hexacis[heptylthio]benzene

Hexacis[octylthio]benzene

Hexacis[nonylthio]benzene

Hexacis[decylthio]benzene

Hexacis[dodecylthio]benzene

Hexacis[tetradecylthio]benzene

Hexacis[hexadecylthio]benzene

Hexacis[octadecylthio]benzene

Hexacis[2-perfluorohexyl-ethylthio]benzene

The preferred compounds of the sub-formula Ib include pentacis[alkylthio]benzenes

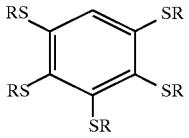

and pentacis[alkylthio]alkoxybenzenes

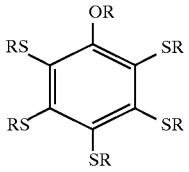

of which the following compounds are particularly suitable:

Pentacis[octylthio]benzene

Pentacis[decylthio]benzene

Pentacis[dodecylthio]benzene

Pentacis[octylthio]octyloxybenzene

Pentacis[octylthio]anisol

The compounds of sub-formula Ic include 1,2,4,5-tetracis[alkylthio]benzenes

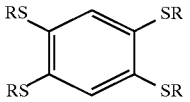

2,3,5,6-tetracis[alkylthio]terephthalic acid alkyl esters

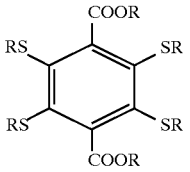

and 2,3,5,6-tetracis[alkylthio]-1,2-dialkoxy-benzenes

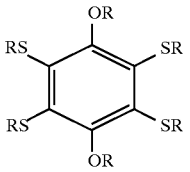

among which terephthalic acid esters are preferred.

Of the compounds of the sub-formula Id phthalic acid esters are preferred:

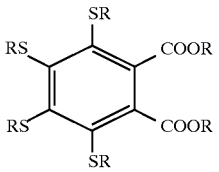

The compounds of formula I are produced using per se known methods as are described in the literature (for example in standard works such as Houben-Weyl. Methoden der Organischen Chemi, Georg-Thieme-Verlag, Stuttgart), more specifically under reaction conditions which are known and suitable for the specified reactions.

Compounds of sub-formulae Ia and Ib are produced by reaction of hexachlorobenzene or pentachlorobenzene or hexafluorobenzene or pentafluorobenzene with a sodium alkyl thiol ate RSNa in an aprotic solvent, N,N-dimethylformamide, N-methyl-2-pyrrolidinone or preferably tetraethyleneglycoldimethylether at 50° to 180° C. For that purpose, the thiolate is firstly produced in one of the specified solvents from mercaptan RSH with sodium hydride or sodium amide. Instead of a pure mercaptan RSH it is also possible to use mixtures of mercaptans so that the result is a mixture of compounds which are embraced by the sub-formulae. It is assumed in accordance with the invention that the reactivity of the various thiolates is the same relative to the halobenzenes so that the compounds have a random substitution pattern in respect of the various alkylthio groups. Such mixtures are distinguished by particularly low melting points, which gives a low pour point which is advantageous in comparison with known lubricants (definition see Ullmanns Enzykl.).

It was surprisingly found that the lubricant according to the invention is excellently well suited for lubricating transmissions and machine bearings. It was also surprisingly found that, when using the lubricating oil according to the invention as engine oil, lower levels of frictional losses can be achieved in internal combustion engines than when using conventional mineral and synthetic oils. That can be observed in particular by virtue of a lower level of fuel consumption in engines used in motor racing, with an engine speed of >8000 rpm.

The advantageous lubricating properties and the extremely advantageous low vapour pressures with relatively low viscosity values also afford for the compounds of formula I advantageous possible uses as lubricating oils for bearings of turbomolecular pumps and oil rotary vacuum pumps.

The following Examples are intended to describe the invention without limiting it. Percentages hereinbefore and hereinafter denote percent by mass.

EXAMPLE 1

69.1 g (2.89 mol) of sodium hydride is added in dry nitrogen to 800 ml of absolute tetraethyleneglycoldimethylether (tetraglyme). A solution of 421 g (2.89 mol) of n-octylmercaptan in 1200 ml of tetraglyme is added dropwise within a period of 2 hours to the suspension with agitation. Thereafter agitation is effected by a further ½ hour and 124.4 g (0.436 mol) of hexachlorobenzene is added. Heating to 130°–135° C. is effected and agitation is effected for 20 hours at that temperature, with the exclusion of moisture. After cooling the reaction flask is provided with a distillation attachment. The solvent is substantially distilled off under vacuum (oil rotary pump) at a bath temperature of 130° C. The residue is cooled down and mixed firstly dropwise and then continuously with a total of 1 of 5% hydrochloric acid. The resulting emulsion is shaken out firstly with 600 ml and then twice more each time with 200 ml of diethylether. The combined organic phases are shaken out three times each time with 75 ml of saturated NaCl-solution and once with 100 ml of water and then dried with $MgSO_4$. After the ether is distilled off the oily crude product of 426 g is mixed with 500 ml of acetone. The cloudy mixture after brief heating under reflux becomes a clear solution from which a yellowish-white crystalline bottom settlings is formed overnight at −25° C. The supernatant brown solution is poured off and the crystals dissolved in a further 500 ml of acetone. After a total of crystallisation three times, effected in the same manner, the crystals are fused and the oil is freed of volatile impurities in a vacuum (0.2 mbar) at 200° C. Yield: 378 g (92% of theory) of hexacis[octylthio]benzene, melting point −6° C., viscosity at 20° C. 120 $mm^2/s$, at 40° C. 51 $mm^2s$, and vapour pressure at 20° C. $<10^8$ mbar.

The isotropic molten material can be supercooled to about −10° C. (polarisation-microscopic observation in a pickling table from Lincam).

A lubricant A comprising 99% of that compound and 1.0% of the high-pressure additive Irgalube 349 (Ciba-Geigy Ltd.) was compared on various items of equipment with conventional lubricants:

a) In a two-disk test stand for measuring the coefficient of friction $\mu$ under elastohydrodynamic conditions (TU of Munich, see K. Michaelis et al, Proc. 10th Intern. Coll. Tribology—Solving Friction and Wear Problems, Vol. 2, pages 1363–75, 1996), at a hertzian pressure of 1000N/$mm^2$, a lubricant temperature of 60° C., a total speed of the disks of 16 m/s and a slippage of 20%, a coefficient of friction $\mu$ of 0.012 was measured (definition see K. Michaelis). In comparison therewith the commercial oil M100 (mineral oil basis ISO VG 100) has a coefficient $\mu$ of 0.031. Particularly low frictional losses in gear transmissions and screw transmissions can be deduced from that result in accordance with known interrelationships.

b) In a test stand for ball-screwthread drives (University of Karlsruhe, see D. Spath et al. Annals of the CIRP Gen. Assembly, Vol. 44/1, Enschede 1995), for ascertaining the frictional characteristics in the hybrid friction region and in the hydrodynamic region, a 40×20 ball-screwthread drive (linear ballbearing) from the company Deutsche Star (individual nuts with four-point contact, ball diameter 6 mm, biasing force 3.5 kN (definition see Spath et al) was operated with the lubricant A. At a temperature of the ball-screwthread drive of 20° C., the frictional moment was measured in dependence on the speed of rotation (all definitions see Spath et al). The transition from hybrid friction to hydrodynamic friction occurs at the speed of rotation n $\bar{u}$ at which, in accordance with the generally known laws, the lowest achievable frictional moment is simultaneously indicated. The rise in frictional moment (in Nm) between $n_{\bar{u}}$ and the high speed of rotation of 1500 $min^{-1}$ is to be attributed to the internal friction in the lubricant. A comparison with the standard oil Tellus C 100 (mineral oil, Shell) yields the following values:

| | | |
|---|---|---|
| Tellus C 100 | 0.88 Nm | ($n_a$ = 40 $min^{-1}$), 1.75 Nm (1500 $min^{-1}$) |
| Lubricating oil A | 0.25 | ($n_a$ = 40 $min^{-1}$), 0.70 Nm (1500 $min^{-1}$) |

EXAMPLE 2

In the manner described in Example 1, a mixture of hexacis[alkylthio]benzenes is produced from 6.9 g of NaH (289 mmol) in 80 ml of tetraglyme, a solution of 11.0 g of hexylmercaptan (96.3 mmol), 13.7 g of octylmercaptan (96.3 mmol) and 16.3 g of decylmercaptan (96.3 mmol) in 120 ml of tetraglyme. The crude product however is not crystallised but is purified by column chromatography (200 g of silica gel (Merck), petroleumbenzine-toluene mixture). The solvent is firstly removed by rotation and the residue is freed of volatile impurities at 200° C. and in an oil pump vacuum at 0.2 mbar.

The mixture is investigated without the addition of additives, on the test stand described in Example 1b. In the speed range of 0 to 1500 $min^{-1}$, the tests yield lower frictional moments than with the comparative oil Tellus C 100.

EXAMPLE 3

In the manner described in Example 1, pentacis [dodecylthio]benzene is produced from 5.8 g of NaH (241 mmol), 80 ml of tetraglyme, a solution of 46.7 g of dodecylmercaptan (241 mmol) in 120 ml of tetraglyme and 10.9 g (43.6 mmol) of pentachlorobenzene. Yield: 40 g (80% of theory), melting point 36° C.

In the same manner and using the same molar relationships, pentacis[octylthio]benzene (melting point 12° C.) is produced starting from pentachlorobenzene and octylmercaptan.

On the test stand described in Example 1b, at 60° C. in the speed range of 0 to 1500 $min^{-1}$, the compound exhibited lower frictional values than the comparative oil Tellus C 100 at the same temperature.

EXAMPLE 4

A mixture of 75% of hexacis[octylthio]benzene with 25% of the low-viscosity compound 4-trans-(4-propyl-cyclohexyl)-ethyl-benzene, in the test stand referred to in Example 1b, under the conditions specified therein, also gave better frictional moments than with the oil Tellus C 100.

EXAMPLE 5

10.0 g of the liquid mixture of compounds of the general formula I from Example 2 was mixed with 0.2 g of the anti-oxidant 2,6-di-tert-butyl-4-methyl-phenol and 1.0 g of the high-pressure additive zinc-dibutyl-dithiophosphate. Stirred into the lubricating oil produced after brief stirring at ambient temperature in the form of a homogenous liquid is 3.0 g of the polytetrafluoroethylene powder Hostafon TF 9202 (Hoechst AG). The suspension is treated at ambient temperature in a commercially usual ultrasound bath (20 KHz, 200 W) for a period of 30 minutes. The resulting lubricating grease has a content of thickener of 21.1%.

What is claimed is:

1. A lubricant comprising at least one lubricant additive and a compound of the general formula:

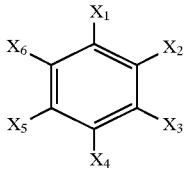

wherein 4, 5 or 6 of the substituents $X_1$ to $X_6$ can be

—SR, —$SO_2$R or —SOR and the other substituents can be

—H, —Cl, —F, —OH, —SH, —R, —OR, —COOR or —OOCR wherein R is independently, at each occurrence, unsubstituted or substituted alkyl, of 1 to 18 carbon atoms, said substitution consisting of fluorine substitution of hydrogen, —O— substitution of —$CH_2$—, —S— substitution of —$CH_2$— and mixtures thereof, said —O— and —S— substitutions being selected so that —O— atoms are not directly bonded to each other.

2. The lubricant of claim 1 wherein all 6 substituents $X_1$ to $X_6$ are —SR.

3. The lubricant of claim 1 wherein 5 substituents $X_1$ to $X_6$ are —SR.

4. The lubricant of claim 1 wherein R independently of each other respectively denotes an unbranched alkyl residue with 1 to 18 C-Atoms.

5. The lubricant of claim 2 wherein R independently of each other respectively denotes an unbranched alkyl residue with 1 to 18 C-Atoms.

6. The lubricant of claim 3 wherein R independently of each other respectively denotes an unbranched alkyl residue with 1 to 18 C-Atoms.

7. A method for lubrication between surfaces which comprises applying a lubricant between the surfaces which includes a compound of the general formula:

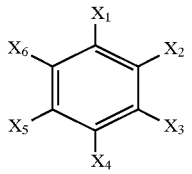

wherein 4, 5 or 6 of the substituents $X_1$ to $X_6$ can be

—SR, —$SO_2$R or —SOR and the other substituents can be

—H, —Cl, —F, —OH, —SH, —R, —OR, —COOR or —OOCR wherein R is independently, at each occurrence, unsubstituted or substituted alkyl, of 1 to 18 carbon atoms, said substitution consisting of fluorine substitution of hydrogen, —O— substitution of —$CH_2$—, —S— substitution of —$CH_2$— and mixtures thereof, said —O— and —S— substitutions being selected so that —O— atoms are not directly bonded to each other.

8. The method of claim 7 wherein all 6 substituents $X_1$ to $X_6$ are —SR.

9. The method of claim 7 wherein 5 substituents $X_1$ to $X_6$ are —SR.

10. The method of claim 7 wherein R independently of each other respectively denotes an unbranched alkyl residue with 1 to 18 C-Atoms.

11. The method of claim 8 wherein R independently of each other respectively denotes an unbranched alkyl residue with 1 to 18 C-Atoms.

12. The method of claim 9 wherein R independently of each other respectively denotes an unbranched alkyl residue with 1 to 18 C-Atoms.

13. The method of claim 7 wherein the lubricant is applied to surfaces of an internal combustion engine.

14. The method of claim 7 wherein the lubricant is applied to surfaces of an internal combustion engine having a piston frequency of greater than 8,000 rpm.

15. The method of claim 8 wherein the lubricant is applied to surfaces of an internal combustion engine having a piston frequency of greater than 8,000 rpm.

16. The method of claim 9 wherein the lubricant is applied to surfaces of an internal combustion engine having a piston frequency of greater than 8,000 rpm.

17. The method of claim 10 wherein the lubricant is applied to surfaces of an internal combustion engine having a piston frequency of greater than 8,000 rpm.

18. The method of claim 11 wherein the lubricant is applied to surfaces of an internal combustion engine having a piston frequency of greater than 8,000 rpm.

19. The method of claim 12 wherein the lubricant is applied to surfaces of an internal combustion engine having a piston frequency of greater than 8,000 rpm.

* * * * *